US006112539A

United States Patent [19]

Colberg

[11] Patent Number: 6,112,539

[45] Date of Patent: Sep. 5, 2000

[54] ICE MAKING AND BAGGING VENDING MACHINE

[76] Inventor: Francisco J. Colberg, 18th St. #1035, Villa Nevarez, Rio Piedras, Puerto Rico 00927

[21] Appl. No.: 09/236,202

[22] Filed: Jan. 23, 1999

[51] Int. Cl.[7] ..... F25C 5/18

[52] U.S. Cl. ..... 62/331; 62/60; 62/344

[58] Field of Search ..... 62/60, 66, 344, 62/331

[56] References Cited

U.S. PATENT DOCUMENTS

| | | | |
|---|---|---|---|
| 2,986,897 | 6/1961 | Howard | 62/344 |
| 3,151,668 | 10/1964 | Zimmermann | 62/344 |
| 3,543,811 | 12/1970 | Lamka | 62/344 |
| 5,277,016 | 1/1994 | Williams et al. | 62/60 |

*Primary Examiner*—William E. Tapolcai
*Attorney, Agent, or Firm*—Michael I Kroll

[57] ABSTRACT

The present invention 10 discloses a device for making, bagging, and delivering a sealed bag of ice 12 to a consumer 22. The user 22 merely deposits a specified amount of money into the coin operated 18 vending machine and the user thereafter receives the completely sealed bag of ice 12. The present invention 10 has refrigeration means 30 which supplies ice 34 into a hopper area 32 having outfeed means 36 for dispensing ice into a bagging means 39. The ice bagging means 39 has a replaceable roll 48 of plastic material which is conveyed through the machine having a cutting and heat sealing means 41 and 43 which cuts out a bag and produces sealed ends on the bag of ice. Thereafter the sealed bag of ice 50 is delivered to the customer access area 20 where the customer 22 can pick up and access the frozen bag of ice.

10 Claims, 6 Drawing Sheets

10
20
50
34
41
39
38
43
44
46
48
44

32
34
36
35
40
41
38

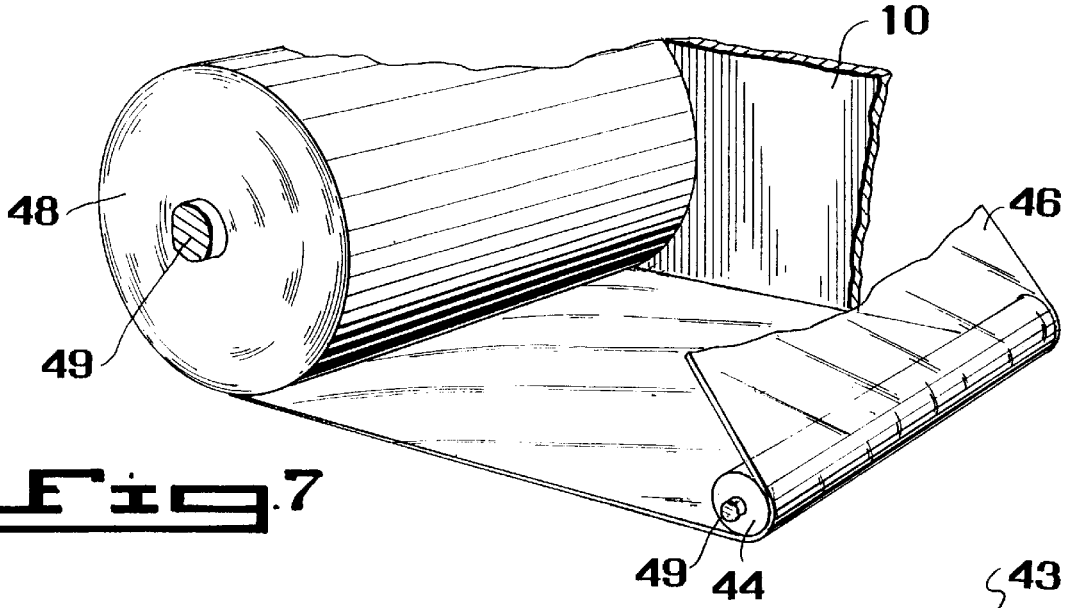
Fig. 7
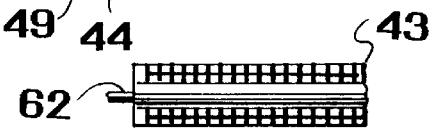
Fig. 8
Fig. 8a
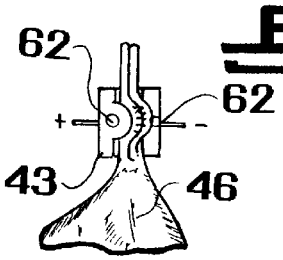
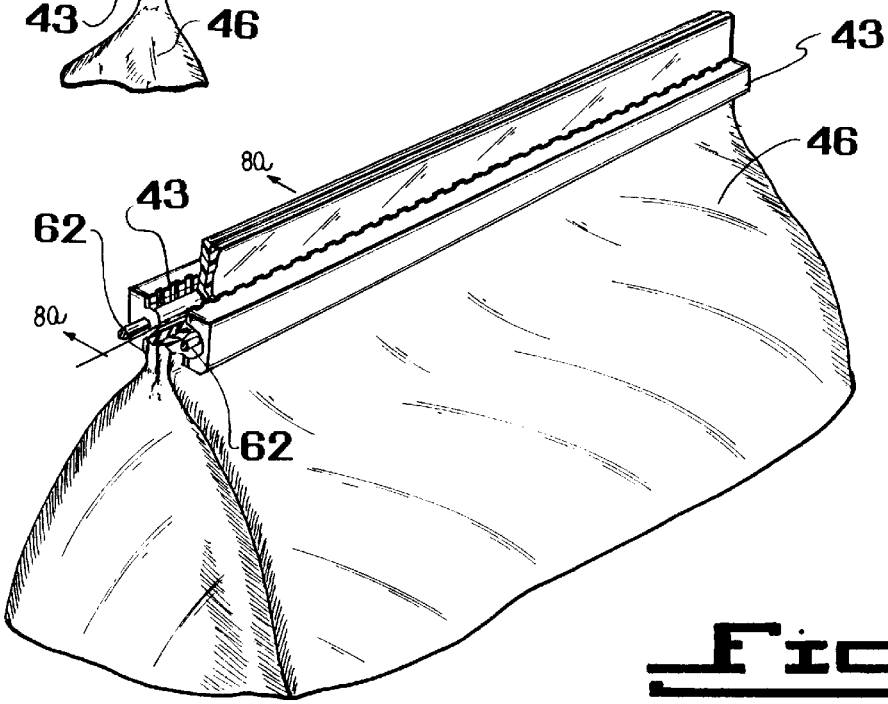
Fig. 9

ICE MAKING AND BAGGING VENDING MACHINE

BACKGROUND OF THE INVENTION

1. Field of the Invention

The present invention relates generally to ice making machines and, more specifically, to an ice making and bagging vending machine whereby consumers can purchase bags of ice by depositing a specified amount of money into the coin operated vending machine having connections for water and electrical supply lines wherein said vending machine having an ice making apparatus continuously supplies ice on demand depositing said ice into a hopper having an egress mechanism for dispensing the ice and control means for engaging production of additional ice by the ice making apparatus and said vending machine having a replaceable roll of tubular plastic sheeting material being conveyed through said vending machine whereupon said vending machine having heat sealing means produces a transverse seam forming one end of the bag and upon further predetermined conveyance said tubular plastic sheeting material having closure at one end is cut to a predetermined length whereupon said vending machine having vacuum means opens said cut end forming a receptacle for the ice being dispensed from the ice holding hopper and said vending machine having a further heat sealing apparatus that hermetically seals said ice within said plastic bag as the bag and contents are deposited within the customer accessible dispensing area of said ice making and bagging vending machine.

2. Description of the Prior Art

There are other ice making dispensing machines located within hotels and motels which provide their customers with open containers of ice that due to the exposed condition of the contents and the number of people sticking their hands in to scoop out some ice have caused these machines, due to unsanitary conditions, to fall into disfavor for any other purpose than to cool sealed beverage containers which does not eliminate the spread of any water borne bacteria located on the exterior of said beverage containers.

There are also freezers located within supermarkets and beverage dispensing super stores having a number of sealed plastic bags of ice for consumer consumption which require some form of delivery, usually by truck, to the store. Barring unforseen traffic and delivery equipment failures this system of dispensing ice is very expensive and is severely taxed during hot summer months especially during long holiday weekends and again the issue is raised as to under what conditions the ice was manufactured, transported and store.

As most municipalities constantly monitor the condition of their water supply, most people are assured that the water being dispensed is potable water.

Therefore, it is felt that a need exists to provide an ice making and bagging vending machine which will eliminate transportation costs, reduce delivery costs by eliminating the need for large storage freezers and provide a continuous, on demand, and renewable supply of ice on site, as well as improving sanitary dispensing conditions by providing the ice product within a sealed container eliminating all handling of the product except by the consumer.

SUMMARY OF THE PRESENT INVENTION

The present invention discloses a device for making, bagging, and delivering a sealed bag of ice to a consumer. The user merely deposits a specified amount of money into the coin operated vending machine and the user thereafter receives the completely sealed bag of ice. The present invention has refrigeration means which supplies ice into a hopper area having outfeed means for dispensing ice into a bagging means. The ice bagging means has a replaceable roll of plastic material which is conveyed through the machine having a cutting and heat sealing means which cuts out a bag and produces sealed ends on the bag of ice. Thereafter the sealed bag of ice is delivered to the customer access area where the customer can pick up and access the frozen bag of ice.

The present invention is an ice making and bagging vending machine whereby consumers can purchase ice packaged in a sealed plastic bag by depositing a specified amount of money into the coin operated vending machine.

The vending machine having an ice making apparatus continuously supplies ice on demand depositing said ice into a hopper having an egress mechanism for dispensing the ice and control means for engaging production of additional ice.

The vending machine also having a replaceable roll of tubular plastic sheeting material that is conveyed through said vending machine whereupon heat sealing means produces a transverse seam forming one end of the bag.

The vending machine also having means for cutting said plastic material to a predetermined length and vacuum means for opening said bag while ice is being dispensed from the ice holding hopper.

The vending machine further having heat sealing means for sealing said ice within said plastic bag as the bag of ice is deposited within the customer accessible dispensing area of the ice making and bagging vending machine.

A primary object of the present invention is to provide an ice dispensing machine.

Another object of the present invention is to provide an ice dispensing machine having on site production capability by means of water supply connection and control means and electrical connection means.

Another object of the present invention is to provide an ice dispensing machine having an apparatus for manufacturing ice, maintaining a reservoir of dispensable ice and means for dispensing said ice.

A still further object of the present invention is to provide an ice dispensing machine having a replaceable roll of tubular plastic material.

A yet further object of the present invention is to provide an ice dispensing machine having heat sealing means for forming plastic bags from said tubular plastic material.

Another object of the present invention is to provide an ice dispensing machine having vacuum means for manipulating said plastic material.

Another object of the present invention is to provide an ice dispensing machine having means for accepting and dispensing currency.

A yet further object of the present invention is to provide an ice dispensing machine which will increase profit margins for retailers by manufacturing ice at the point of sale.

A still further object of the present invention is to provide an ice dispensing machine that provides sanitary dispensing conditions by packaging the ice product within a sealed container eliminating all handling of the product except by the consumer.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

FIG. 7 is an enlarged perspective view of the plastic bag guiding roll and cutter.

FIG. 8 is a sectional view of the heat sealing components operatively engaged with the bag to seal the bag.

FIG. 8*a* is an elevational front view of the gripping and heat sealing element of the present invention, taken from FIG. 9 as indicated.

FIG. 9 is a perspective view of the combined bag feed grips and sealing elements.

LIST OF REFERENCE NUMERALS

Figure 1:
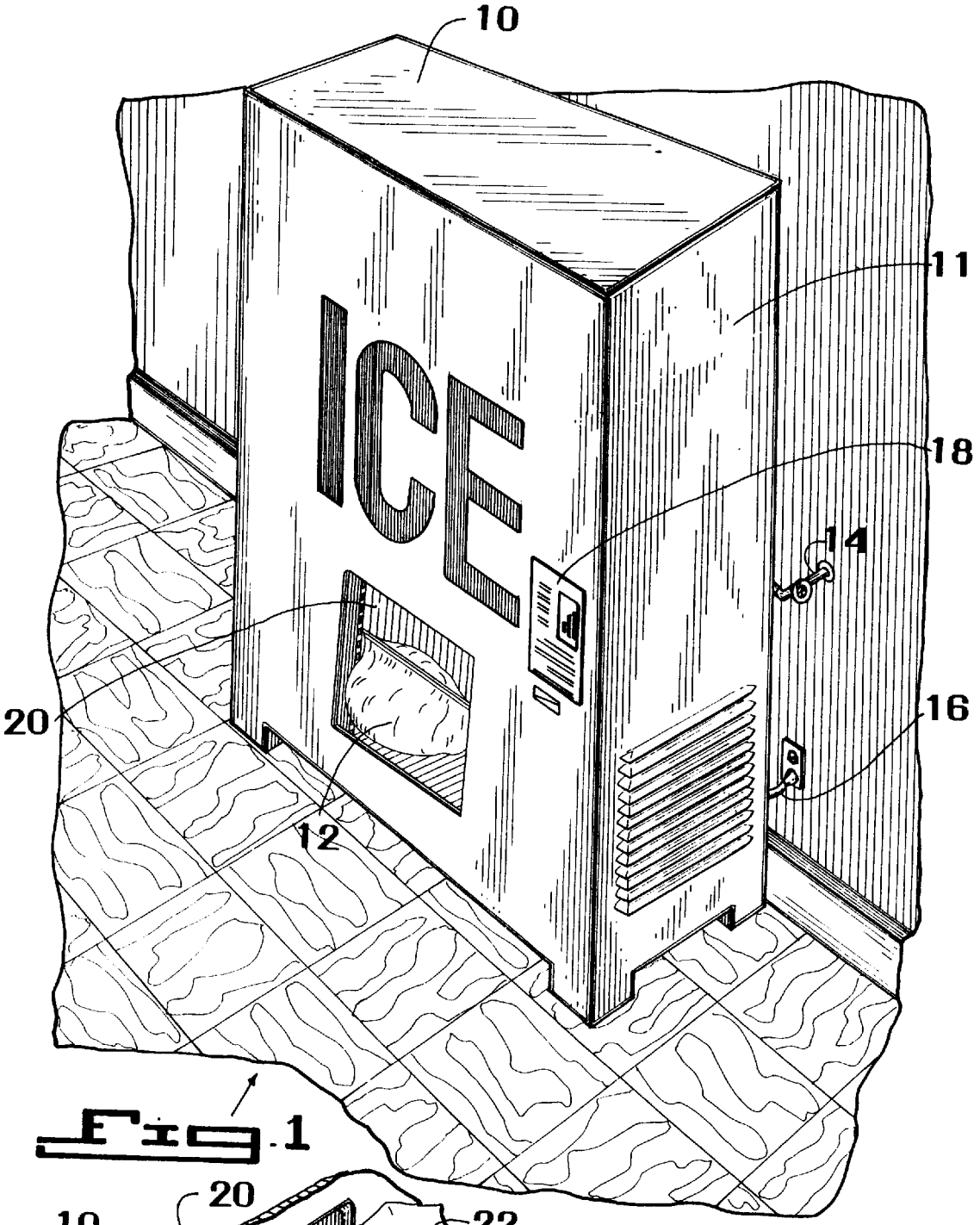
FIG. 1 Is a perspective view of the present invention. Shown is a bag of ice ready to be retrieved by the customer. Also shown is the water supply and electrical connections, as well as the currency depositing and dispensing member and the consumer access terminal of the present invention.

With regard to the reference numerals used, the following numbering is used throughout the various figures.

10 present invention
11 housing
12 bag of ice
14 water supply
16 electrical connections
18 coin dispenser
20 user access
22 user
24 motor
26 coil
28 condenser
30 icemaker
32 ice hopper
34 ice
36 spiral means
37 carriage means
38 bag
39 bagger mechanism
40 vacuum tube means
41 upper metal jaws
43 lower metal jaws
44 rollers
45 suction holes
46 plastic material
48 roll of plastic
49 roller mounts
50 filled bag of ice
56 electric motor
58 drive means
59 drive means
60 vacuum producing means
62 heating element

DESCRIPTION OF THE PREFERRED EMBODIMENT(S)

Turning now descriptively to the drawings, in which similar reference characters denote similar elements throughout the several views, FIGS. 1 through 9 illustrate the present invention being a device for making and bagging ice.

Turning to FIG. 1, therein is shown a perspective view of the present invention generally shown at 10. Shown is the housing 11, and a bag of ice 12 ready to be retrieved by the customer. Also shown is the water supply 14 and electrical connections 16, as well as the currency or coin/bill depositing and dispensing member 18 and the consumer access terminal 20 of the present invention 10.

Figure 2:
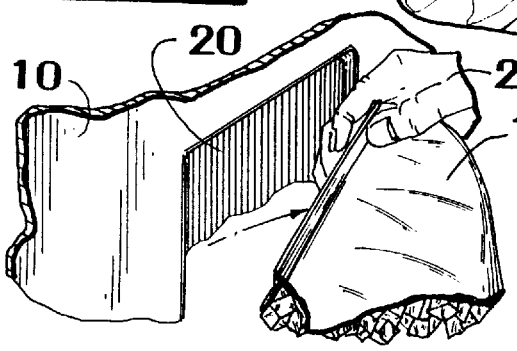
FIG. 2 is a fragmentary perspective view of a sealed bag of ice in the process of being removed by the customer from the ice making and bagging machine of the present invention.

Turning to FIG. 2, therein is shown a fragmentary perspective view of a sealed bag of ice 12 in the process of being removed by the customer 22 from the user access area 20 of the ice making and bagging machine 10 of the present invention.

Figure 3:
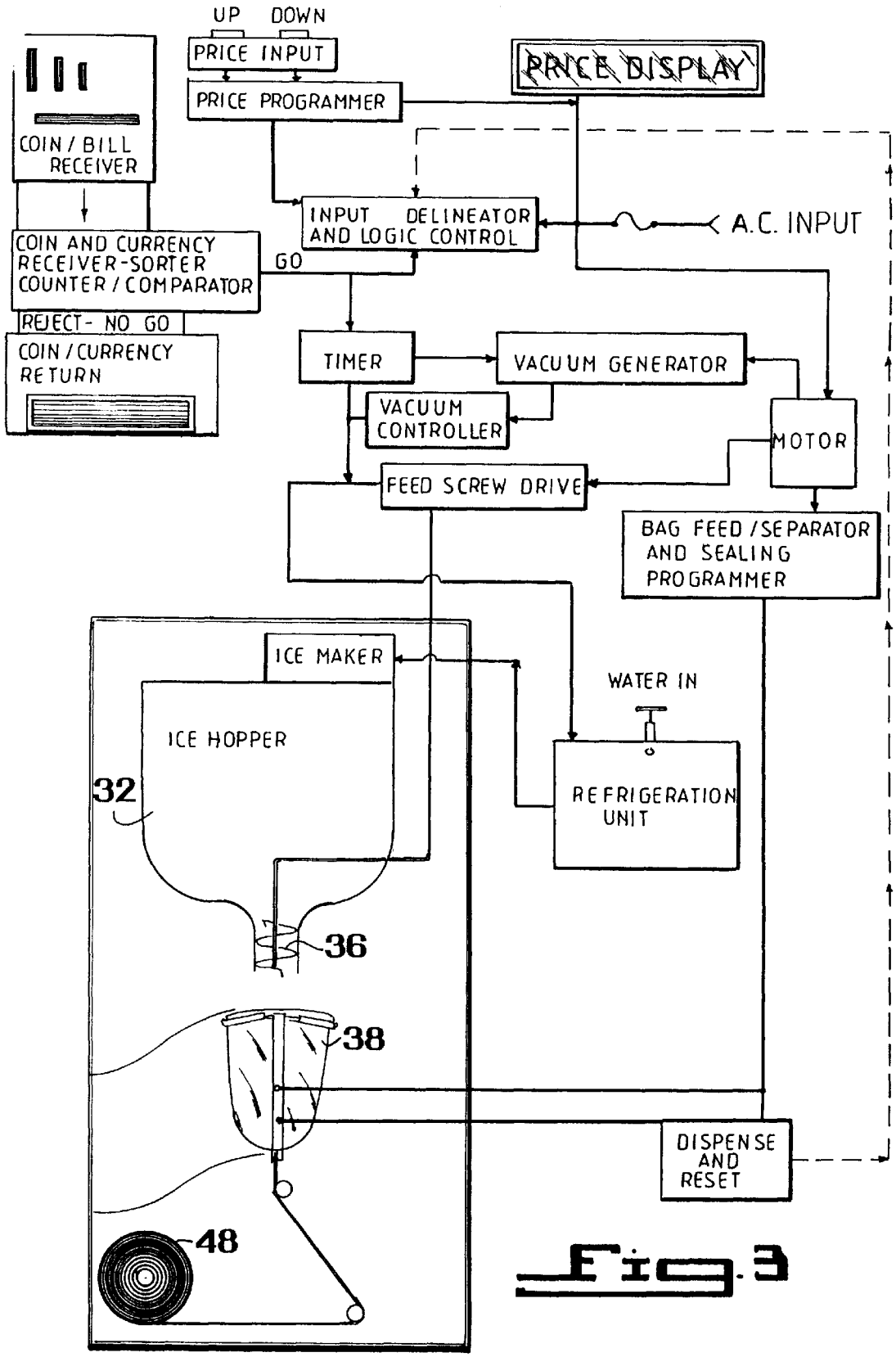
FIG. 3 is an operational flow diagram showing the details of operation of the ice making and bagging vending machine of the present invention.

Turning to FIG. 3, therein is shown a schematic operational flow diagram showing additional details of the operation of the ice making and bagging vending machine of the present invention 10. Shown therein is the coin/bill receiver, the coin and currency receiver-sorter counter/comparator, with reject, no, and go alternatives, the coin/currency return with the comparator sending an input go signal into the input delineator and logic control which has an AC signal input. Also, the input delineator and logic control receives an input signal from the price programmer which receives input from the price input means having an up and down signal generator and further the price programmer having an output to the price display output. The input delineator and logic control also receives a signal from the dispense and reset means shown near the bottom of FIG. 3. Also shown therein is a timer having an output signal to the vacuum generator having an output signal to the vacuum controller. Also shown is the feed screw drive which receives input from the motor which has an output signal to the bag feed-separator and sealing programmer. Also shown is the refrigeration unit which has a water input supply connection and which supplies refrigeration capacity to the ice maker which in turn delivers ice to the ice hopper 32 having ice outfeed means 36 which in turn delivers ice into the bag 38 which is being supplied from the bag supply means 48 comprising rollers 44.

Figure 4:
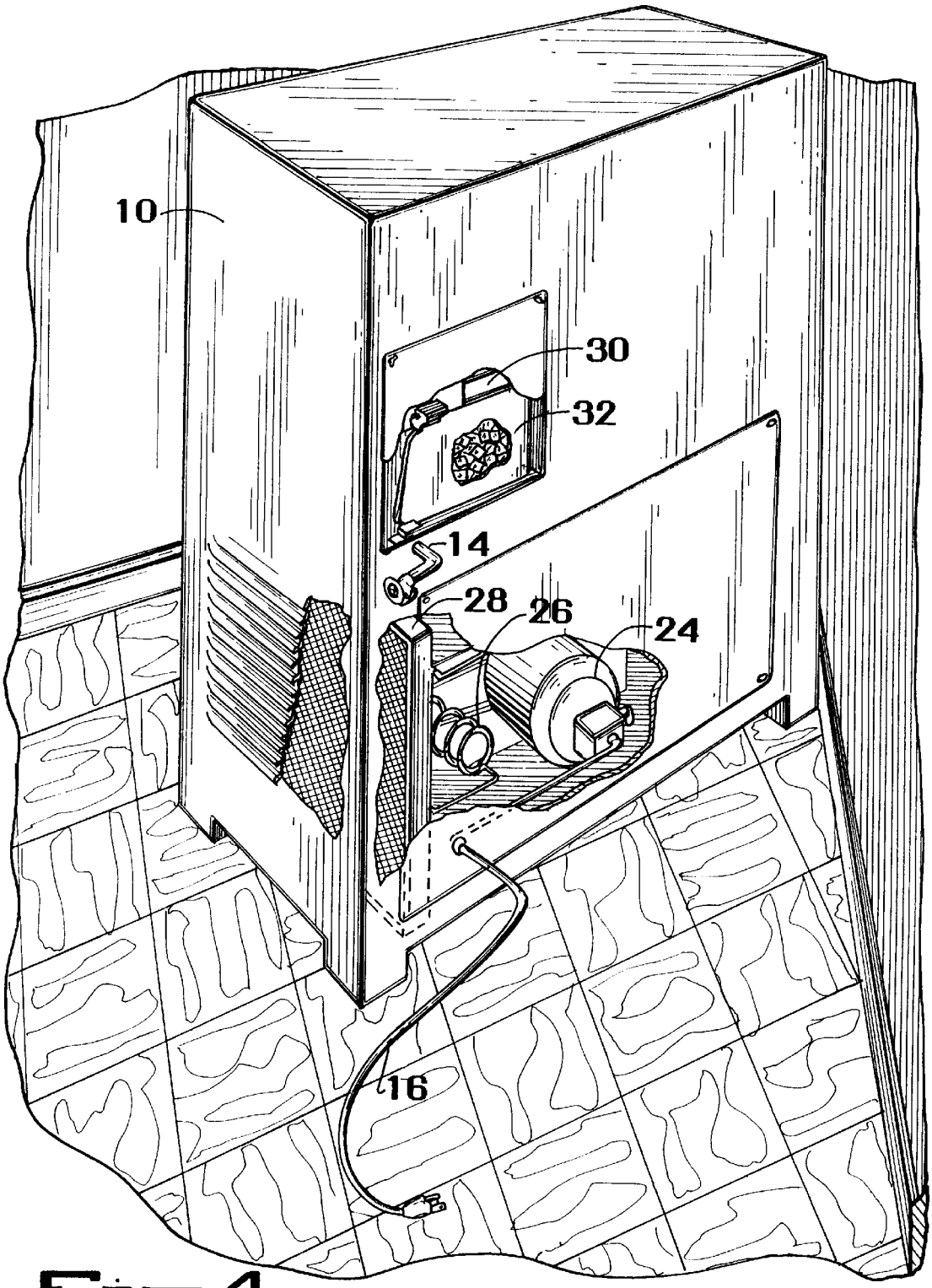
FIG. 4 is a rear perspective view showing the ice making and bagging vending machine partially broken away to illustrate parts of the refrigeration system including a motor, refrigeration coils, condenser, ice maker and ice hopper.

Turning to FIG. 4, therein is shown a rear perspective view showing the ice making and bagging vending machine 10 partially broken away to illustrate parts of the refrigeration system of the standard type including a motor 24, refrigeration coils 26, condenser 28, icemaker 30, and ice hopper 32. The electrical connection 16 and water supply 14 is also shown.

Figure 5:
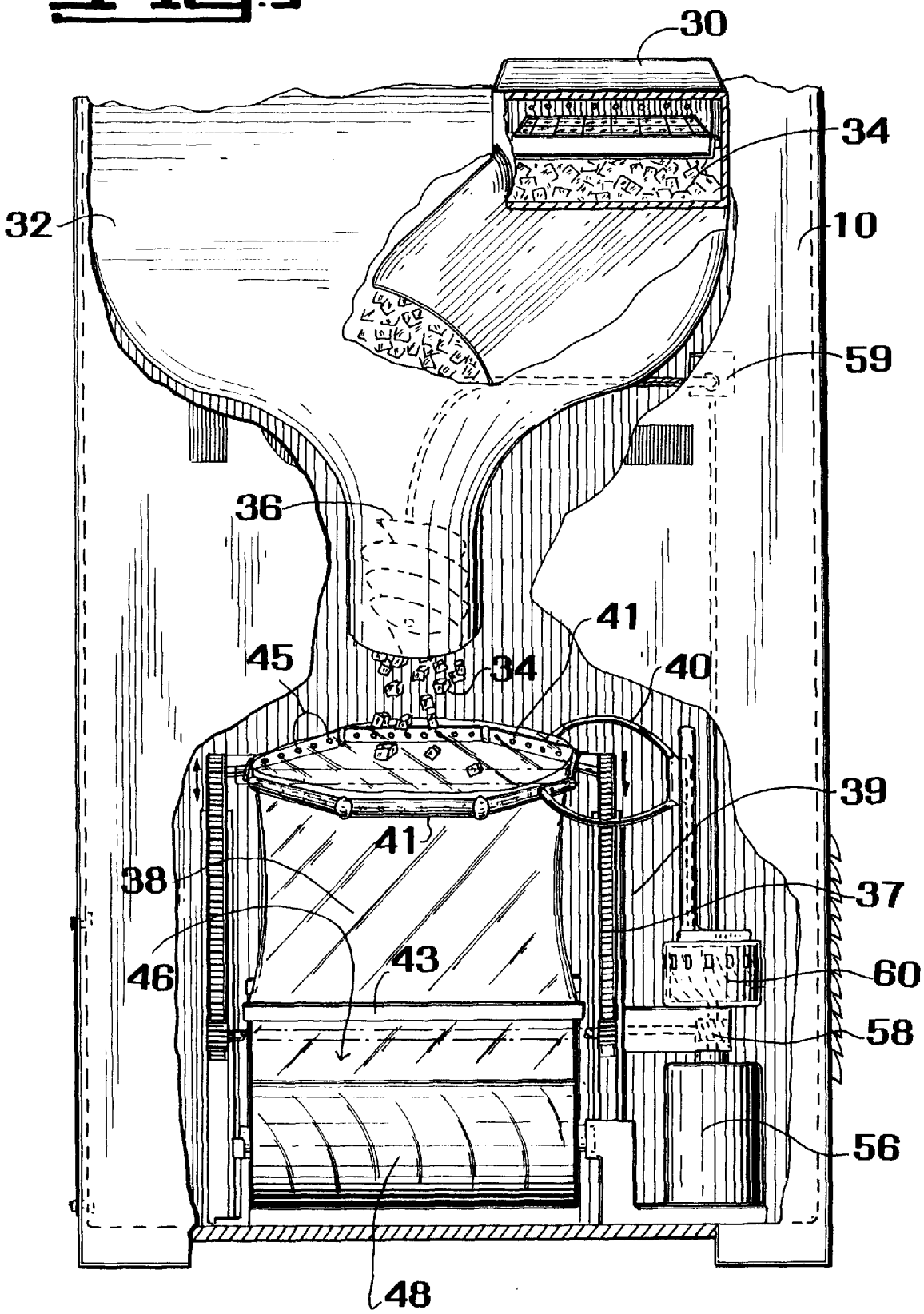
FIG. 5 is a fragmentary perspective view showing the components of the ice dispensing machine wherein an ice maker continuously deposits ice into a hopper whereupon a spiral member, when in the operative mode, will dispense a predetermined amount of ice into the plastic bag which is being held open by vacuum means.

Turning to FIG. 5, therein is shown a fragmentary perspective view showing the components of the ice dispensing machine 10 showing an icemaker 30 continuously depositing ice 34 into a hopper 32 whereupon outfeed means being, e.g., a spiral member 36, when in the operative mode, will dispense a predetermined amount of ice 34 into the plastic bag 38 which is being held open by vacuum means 41. When coins are deposited into the coin slots, the timer is activated, putting the bagger mechanism generally shown at 39 into action. This mechanism utilizes a plastic bag roll 48 that can be evenly dispensed on a per-bag basis by the use of vacuum-controlled metal jaws 41 that lift the plastic bag material 46 into position and with the vacuum automatically opens the bag 38. At this time the ice hopper 32 must be opened for a fixed time to fill the bag. The timer will control the opening and closing of the hopper 32. After the bag 38 is filled, heat-sealing means included in the upper jaws 41 and lower jaws 43 at the base of the bag material 46 seal both top and bottom of the plastic to form the bag 38. At this time the ice bag can be removed from the machine. A carriage means 37 is provided to allow the upper suction jaw 41 and lower jaw 43 to move up and down. Electric motor means 56 is provided to provide drive means 58 to the carriage means 37, and to also provide vacuum producing means 60 with the vacuum being conveyed through tube 40 to the upper jaw 41. Motor 56 also provides drive means 59 to the spiral means 36. In operation the upper jaws 41 being initially open, thereafter close onto the plastic material 46 near the bottom of the bagger mechanism 39 and then travel up the carriage means 37 opening the plastic material 46 by suction or negative pressure which contacts the plastic material 46 through holes 45. Following the ice 34 being dispensed into the bag 38, the upper jaw 41 and lower jaw 43 seals and cuts the plastic material 46 to form the bag 38.

Figures 6, 6A:
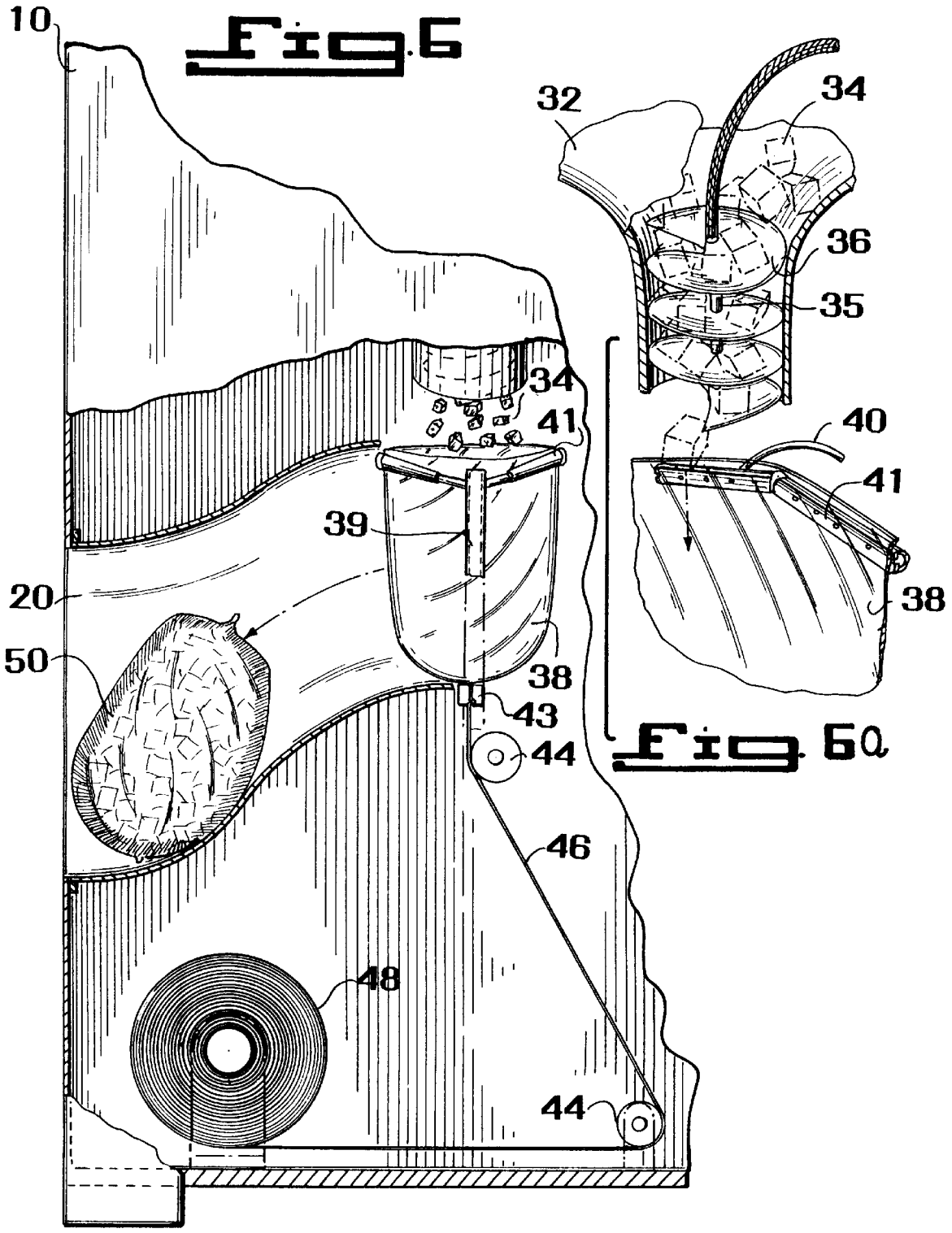
FIG. 6 is a fragmentary perspective view showing the ice making and bagging vending machine depositing ice into a plastic bag and a previously filled and sealed bag dropping by means of gravity to the customer accessible dispensing area of said ice making and bagging vending machine.
FIG. 6A is a fragmentary perspective view showing the spiral member metering a predetermined amount of ice into the open plastic bag.

Turning to FIG. 6, therein is shown a fragmentary perspective view showing the ice making and bagging vending machine 10 depositing ice 34 into a plastic bag 38 and a previously filled and sealed bag 50 dropping by means of gravity into the customer accessible dispensing area 20 of the ice making and bagging vending machine 10. Also shown is the plastic roll 48, the plastic sheet 46, along with rollers 44 which guide the plastic sheet 46 into the bagging mechanism 39. Shown are the upper 41 and lower 43 metal jaws in operative connection with the plastic bag 38.

Turning to FIG. 6A, therein is shown a fragmentary perspective view showing the rotatable spiral member 36 metering a pre-determined amount of ice 34 into the open plastic bag 38 from the hopper bottom 32. Mounting means 35 for the spiral means 36 is also shown. Also shown is the upper jaw 41 and vacuum tube means 40 which is used to hold the bag 38 open.

Turning to FIG. 7, therein is shown an enlarged perspective view of the plastic bag roll 48 showing the roll of dual layered plastic bag material 48 the unrolled plastic material 46 the guiding roll 44 along with the wall of the present invention 10. Both the roll 48 and roller 44 have means for being rotably mounted 49.

Turning to FIG. 8, therein is shown a sectional view of the electrically operated heat sealing component means 43 being dual jaws operatively engaged with the bag material 46 to seal the bag also showing heating elements 62.

Turning to FIG. 8A, therein is shown an elevational front view of the gripping and heat sealing element 43 of the present invention 10 taken from FIG. 9 as indicated also showing the heating element 62.

Turning to FIG. 9, therein is shown a perspective view of the combined bag feed grips or jaws 43 and heating elements 62 along with the bag material 46.

What is claimed is new and desired to be protected by Letters Patent is set forth in the claims:

1. An apparatus for making and bagging ice, comprising:

a) a housing for holding the components of the apparatus;

b) a refrigeration unit for producing ice;

c) a hopper for holding ice;

d) outfeed means for delivering ice from said hopper;

e) ice bagging means for bagging said ice received from said hopper;

f) plastic bag material supply means for supplying bag material to said ice bagging means; and, g) access means whereby a user can access the bag of ice from said housing; said ice bagging means comprising means for contacting and opening plastic bag material whereby said ice can be conveyed into said bag material, said means for contacting and opening plastic bag material comprises means for opening said plastic bag material; means for creating a vacuum; and an upper jaw having holes therein for contacting said plastic bag material and applying a negative pressure thereto.

2. The apparatus of claim 1, said outfeed means further comprising means for spirally removing ice from said hopper.

3. The apparatus of claim 2, said means for spirally removing ice further comprises means for being rotably mounted.

4. The apparatus of claim 2, said means for spirally removing ice further comprises means for being driven by an electrical motor.

5. The apparatus of claim 1, further comprising a water supply and an electrical energy supply.

6. The apparatus of claim 1, said upper jaw means communicating with said lower jaw means said communication further comprising carriage means wherein said upper jaw means and said lower jaw means move in the vertical plane on said carriage means.

7. The apparatus of claim 6, said carriage means further comprising means for being driven by an electrical motor.

8. The apparatus of claim 1, further comprising means for a coin operated mechanism whereby the operation of said apparatus is initialized.

9. The apparatus of claim 1, said plastic bag material supply means further comprising a roll of plastic bag material.

10. An apparatus for making and bagging ice, comprising:

a) a housing for holding the components of the apparatus;

b) a refrigeration unit for producing ice;

c) a hopper for holding ice;

d) outfeed means for delivering ice from said hopper;

e) ice bagging means for bagging said ice received from said hopper;

f) plastic bag material supply means for supplying bag material to said ice bagging means; and g) access means whereby a user can access the bag of ice from said housing, wherein said ice bagging means includes means for cutting and sealing the plastic bag material whereby said ice bags are produced, said cutting and sealing means including means for heat sealing the plastic bag material and said heat sealing means includes an upper jaw and a lower jaw for use in producing said ice bags.

* * * * *